US009702367B2

(12) United States Patent
Wu

(10) Patent No.: US 9,702,367 B2
(45) Date of Patent: Jul. 11, 2017

(54) CENTRIFUGAL FAN

(71) Applicant: ASIA VITAL COMPONENTS CO., LTD., New Taipei (TW)

(72) Inventor: Chun-Ming Wu, New Taipei (TW)

(73) Assignee: Asia Vital Components Co., ltd., New Taipei (TW)

( * ) Notice: Subject to any disclaimer, the term of this patent is extended or adjusted under 35 U.S.C. 154(b) by 361 days.

(21) Appl. No.: 14/322,899

(22) Filed: Jul. 2, 2014

(65) Prior Publication Data

US 2016/0003258 A1 Jan. 7, 2016

(51) Int. Cl.
*F04D 25/06* (2006.01)
*F04D 17/04* (2006.01)

(52) U.S. Cl.
CPC ..... *F04D 25/0613* (2013.01); *F04D 17/04* (2013.01)

(58) Field of Classification Search
CPC ... F04D 17/04; F04D 25/0613; F04D 29/4226
USPC ..... 415/203; 416/198 R
See application file for complete search history.

(56) References Cited

U.S. PATENT DOCUMENTS 7,255,532 B2 * 8/2007 Zheng ..... F04D 17/04 415/183
7,416,388 B2 * 8/2008 Huang ..... F04D 29/646 310/67 R
2005/0095132 A1 * 5/2005 Kao ..... F04D 29/30 416/186 R
2007/0253813 A1 * 11/2007 Liu ..... F04D 25/0613 415/206
2009/0263232 A1 * 10/2009 Jarrah ..... F04D 25/0613 415/4.4
2012/0207596 A1 * 8/2012 Chou ..... F04D 29/4226 415/224
2012/0255713 A1 * 10/2012 Horng ..... F04D 25/0613 165/121

(Continued)

FOREIGN PATENT DOCUMENTS

CN 101994707 A 3/2011
CN 102782605 A 11/2012

(Continued)

OTHER PUBLICATIONS

Machine Translation of DE 202013000433 [retrieved on Aug. 31, 2016]. Retrieved from: Espacenet.*

*Primary Examiner* — Nathaniel Wiehe
*Assistant Examiner* — Eric Zamora Alvarez
(74) *Attorney, Agent, or Firm* — C. G. Mersereau; Nikolai & Mersereau, P.A.

(57) ABSTRACT

A centrifugal fan includes a fan frame and a fan impeller received in the fan frame. The fan frame has at least one air inlet and at least one air outlet respectively formed on two sides of the fan frame. The fan impeller has a hub, an extension section outward extending from the hub and multiple blades disposed on the extension section. Each blade has a front end and a rear end. The rear ends of the blades are annularly arranged to together define a virtual geometrical configuration. A flow guide space is defined between the virtual geometrical configuration and the hub. A chord length is defined between the front and rear ends of the blade. The flow guide space has a width larger than or equal to the chord length so as to thin the centrifugal fan and enhance the performance thereof.

11 Claims, 11 Drawing Sheets

(56) References Cited

U.S. PATENT DOCUMENTS

| | | | | |
|---|---|---|---|---|
| 2012/0294713 | A1* | 11/2012 | Horng | F04D 17/04 415/208.1 |
| 2013/0089425 | A1* | 4/2013 | Wu | F04D 25/0613 416/198 R |
| 2013/0170968 | A1* | 7/2013 | Liu | F04D 29/4226 415/182.1 |
| 2013/0343874 | A1* | 12/2013 | Li | F04D 29/58 415/116 |

FOREIGN PATENT DOCUMENTS

| | | | | |
|---|---|---|---|---|
| CN | 202768489 | U | 3/2013 | |
| TW | I262991 | U | 10/2006 | |
| TW | M421993 | U | 2/2012 | |
| TW | DE 202013000433 | U1 * | 1/2013 | F04D 25/0613 |
| TW | M491096 | U | 12/2014 | |

* cited by examiner

CENTRIFUGAL FAN

BACKGROUND OF THE INVENTION

1. Field of the Invention

The present invention relates generally to a centrifugal fan, and more particularly to a centrifugal fan having thinner thickness and higher performance. Also, the noise made by the centrifugal fan is lowered.

2. Description of the Related Art

Recently, various electronic apparatuses (such as notebooks or tablets) have become thinner and thinner and lighter and lighter. As a result, the internal space of the electronic apparatus is quite limited. In this case, the cooling fan mounted in the internal space is required to have a thin thickness. Also, the space between the cooling fan and adjacent components is quite limited so that the heat dissipation effect of the cooling fan is poor. Especially, under the limitation of space, the airflow of the cooling fan can be hardly uniformly sent out from the outlet of the cooling fan. This will affect the heat dissipation efficiency.

A prior centrifugal fan is disclosed. Multiple blades are disposed on a top face of the hub of the centrifugal fan. The second ends of the blades are annularly arranged to together define a virtual geometrical configuration. The virtual geometrical configuration has a maximum outer diameter. The second ends of each two adjacent blades are spaced by a gap. The gap is smaller than the maximum outer diameter of the virtual geometrical configuration so as to enhance the heat dissipation effect.

The above centrifugal fan has better heat dissipation effect. However, there is still a problem existing in such centrifugal fan. That is, the blades are disposed on the top face of the hub. Therefore, the axial height of such centrifugal fan is higher than that of the hub of the common centrifugal fan. In other words, the original height of the hub plus the height of the blades will lead to a considerable increase of the total axial height of the fan impeller. As a result, the total height of the fan frame for receiving the fan impeller is greatly increased. As shown in FIG. 2, the total axial height of the fan frame is the axial height of the sidewall section plus the axial height of the lateral outlet or inlet. The axial height of the fan frame equals the total height of the fan impeller. In this case, the conventional centrifugal fan can be hardly thinned and the thickness cannot be saved. Under such circumstance, it will be impossible to install the centrifugal fan in the limited internal space of the electronic apparatus. Therefore, it has become a critical issue in this field how to thin the centrifugal fan, while still having an excellent heat dissipation performance.

SUMMARY OF THE INVENTION

It is therefore a primary object of the present invention to provide a centrifugal fan having thinner thickness and higher performance.

To achieve the above and other objects, the centrifugal fan of the present invention includes a fan frame and a fan impeller. An upper side and a lower side of the fan frame are closed. The fan frame has an internal receiving space for receiving the fan impeller. The fan frame has at least one air inlet and at least one air outlet in communication with the receiving space. The air inlet and the air outlet are respectively formed on one side of the fan frame and another side of the fan frame. The fan impeller has multiple blades, an extension section and a hub. The extension section outward extends from an outer circumference of the hub. The blades are disposed on the extension section in a direction away from the hub. Each blade has a front end and a rear end. The rear ends of the blades are annularly arranged to together define a virtual geometrical configuration. A flow guide space is defined between the virtual geometrical configuration and the hub. A chord length is defined between the front end and the rear end of the blade. The flow guide space has a width larger than or equal to the chord length of the blade. The centrifugal fan of the present invention is such designed that the blades are disposed on the hub in a radial direction so that the axial height of the hub is reduced. Therefore, the total axial height of the fan frame is also reduced. In this case, the centrifugal fan is thinned and the performance of the centrifugal fan is enhanced.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
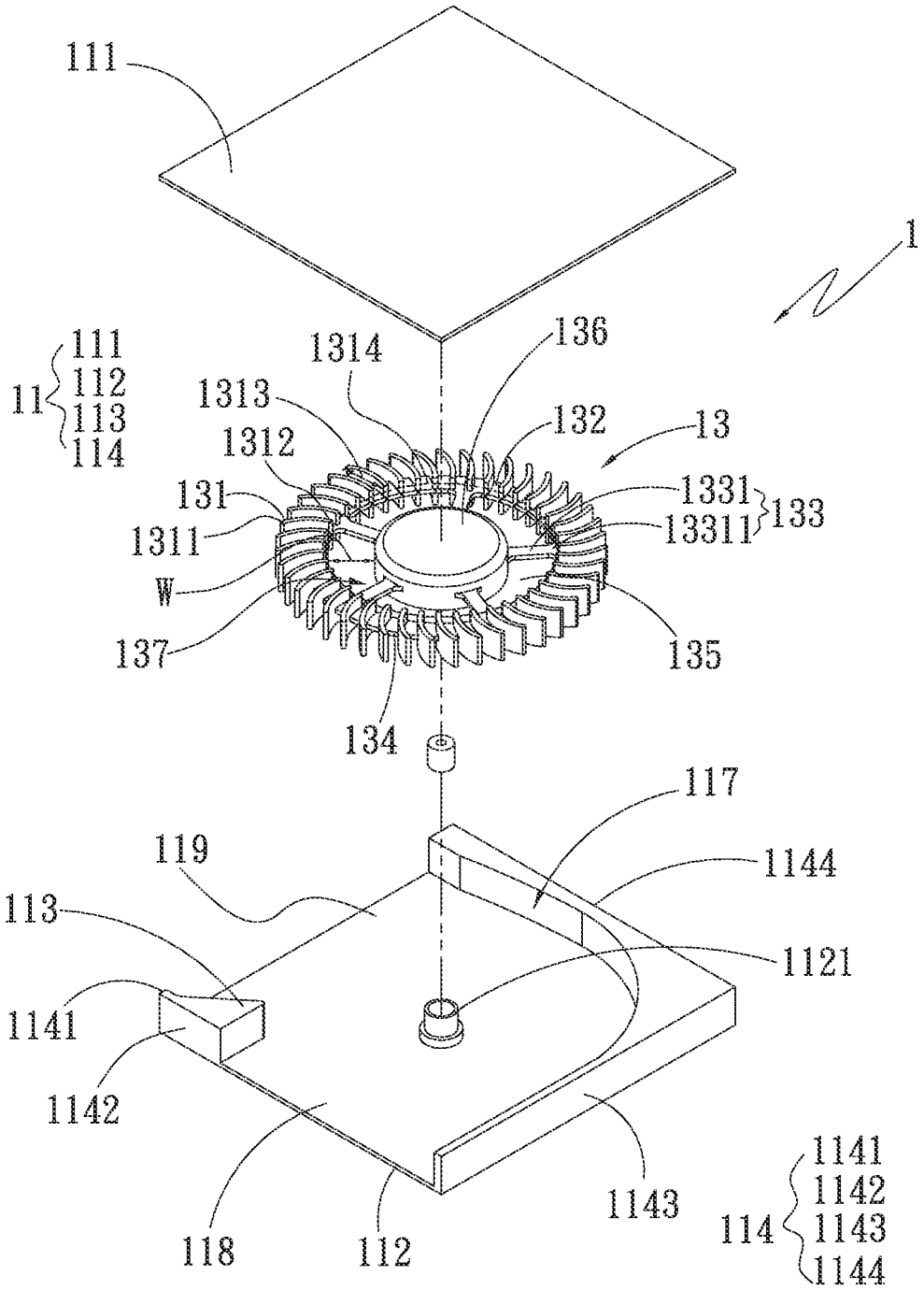
FIG. 1 is a perspective exploded view of a first embodiment of the present invention.
Figure 2:
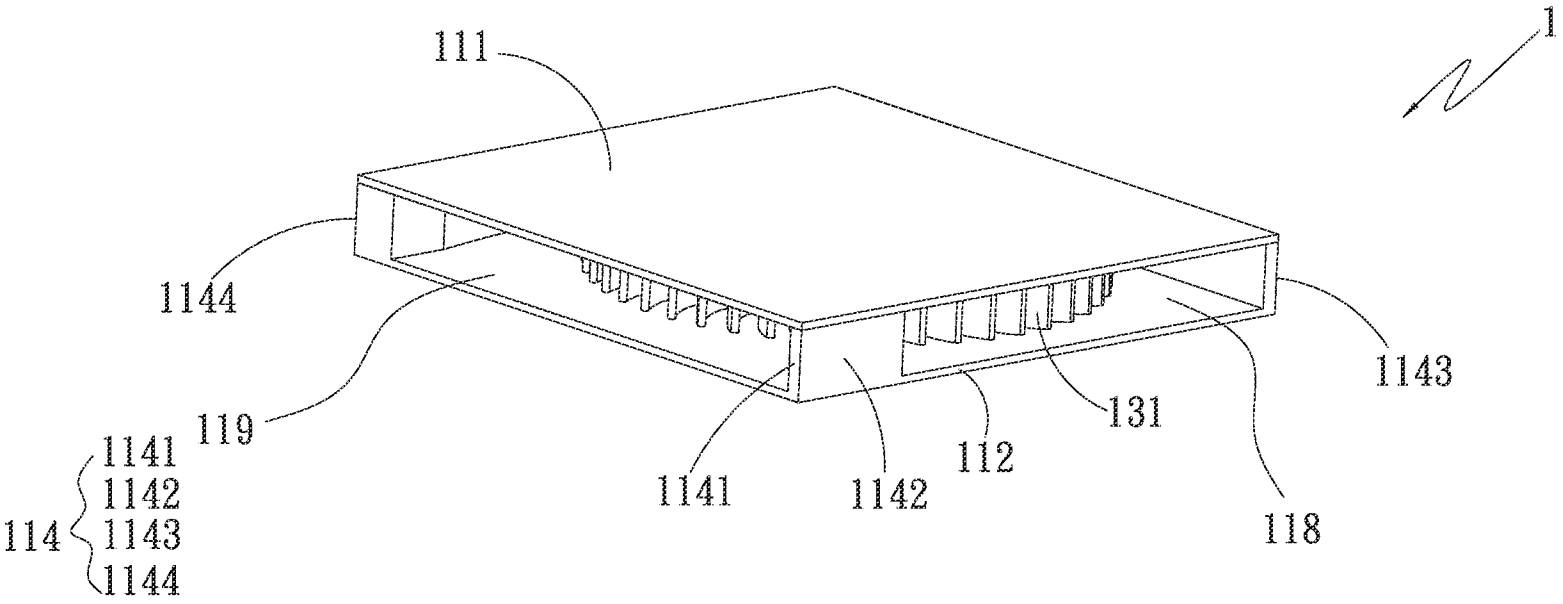
FIG. 2 is a perspective assembled view of the first embodiment of the present invention.

Please refer to FIGS. 1 and 2. FIG. 1 is a perspective exploded view of a first embodiment of the present invention. FIG. 2 is a perspective assembled view of the first embodiment of the present invention. Also referring to FIG. 3, the centrifugal fan 1 is installed in an electronic apparatus such as a notebook, a tablet, an iPad or a portable wearable device (not shown). The centrifugal fan 1 includes a fan frame 11 and a fan impeller 13. The upper and lower sides of the fan frame 11 are closed. The fan frame 11 has an internal receiving space 117. The fan frame 11 has at least one air inlet 118, at least one air outlet 119, a cover board 111, a bottom board 112, a stop tongue section 113 and a sideboard 114. The air inlet 118 and the air outlet 119 communicate with the receiving space 117. The air inlet 118 and the air outlet 119 are respectively formed on one side of the fan frame 11 and another side (an adjacent side) of the fan frame 11. That is, the air inlet 118 and the air outlet 119 are respectively formed on a first sidewall 1141 and a second sidewall 1142 of the sideboard 114. The cover board 111, the bottom board 112 and the sideboard 114 together define the receiving space 117 in communication with the air inlet 118 and the air outlet 119. The sideboard 114 upward extends from a periphery of the bottom board 112. The cover board 111 is disposed at one end of the sideboard 114, which end is distal from the bottom board 112, to cover the receiving space 117. In this embodiment, the sideboard 114 and the bottom board 112 are integrally formed for illustration purposes. The bottom board 112 and the cover board 111 are closed without any perforation.

A bearing cup 1121 is disposed on the bottom board 112 and received in the receiving space 117 near the center thereof. That is, the bearing cup 1121 axially protrudes from the center of the bottom board 112 into the receiving space 117. The fan impeller 13 is rotatably connected with the bearing cup 1121. The sideboard 114 includes the first sidewall 1141, the second sidewall 1142, a third sidewall 1143 and a fourth sidewall 1144. In this embodiment, the first and second sidewalls 1141, 1142 are normal to each other for illustration purposes. The stop tongue section 113 extends from a junction between the first and second sidewalls 1141, 1142 into the receiving space 117 in adjacency to and corresponding to the fan impeller 13. The stop tongue section 113 serves to prevent (or hinder) the airflow of the air outlet 119 from flowing back and leaking out from the air inlet 118. Accordingly, the airflow coming into the air inlet 118 will not interfere with the airflow going out of the air outlet 119. In this case, the air can be more easily taken into the air inlet 118 to increase the utility efficiency of the incoming air of the centrifugal fan 1 and thus lower the noise and increase the air volume and wind pressure.

Figure 4A:
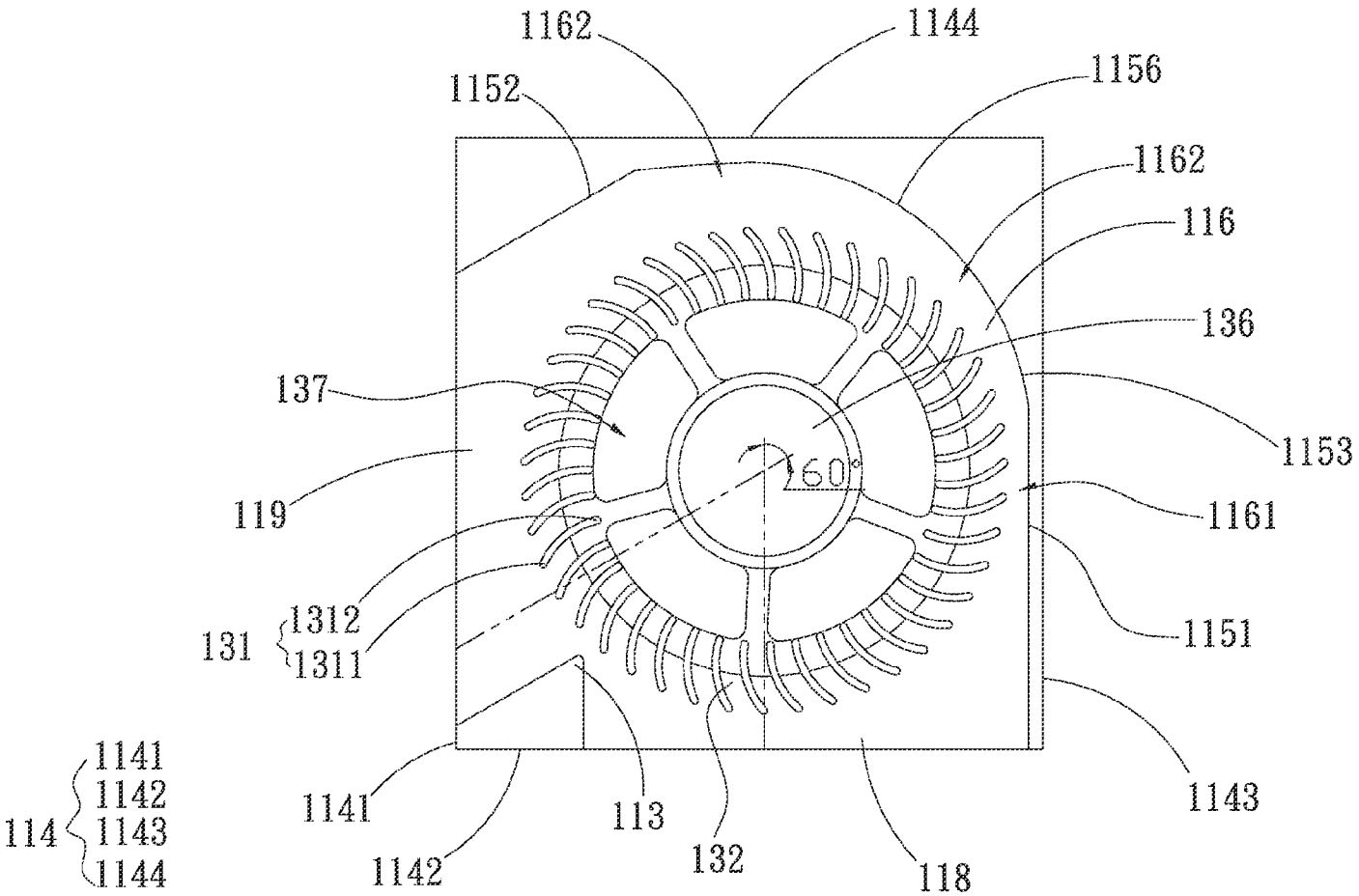
FIG. 4A is another top view of the first embodiment of the present invention.
Figure 4B:
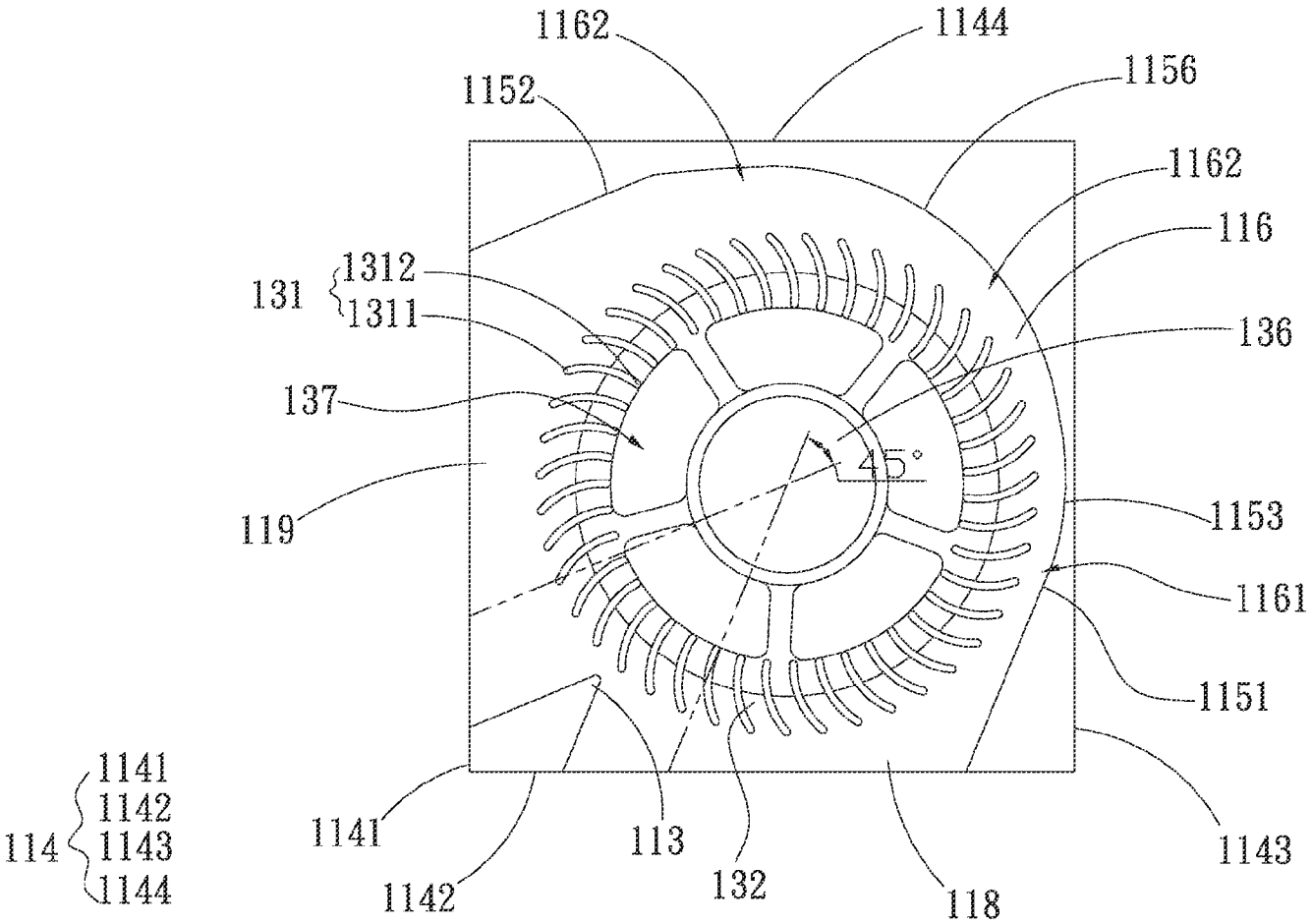
FIG. 4B is still another top view of the first embodiment of the present invention.
Figure 4C:
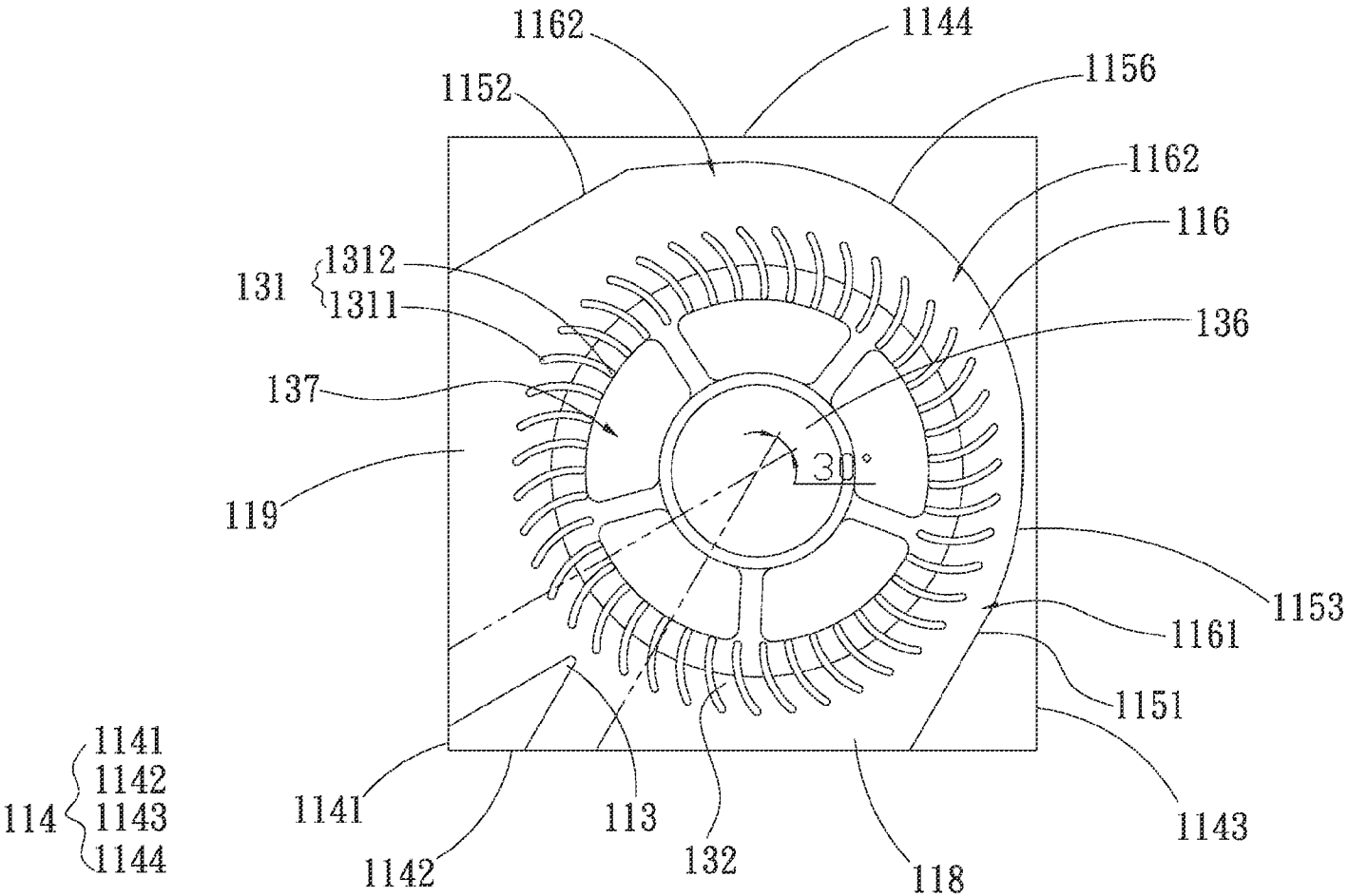
FIG. 4C is still another top view of the first embodiment of the present invention.

The air outlet 119 is positioned between the stop tongue section 113 and the fourth sidewall 1144 opposite to the third sidewall 1143. The air inlet 118 is positioned between the stop tongue section 113 and the third sidewall 1143 opposite to the fourth sidewall 1144. The air outlet 119 and the air inlet 118 contain an angle ranging from 30 degrees to 90 degrees. The angle is an angle contained between a phantom line extending from the axis of the hub 136 to the air outlet 119 and a phantom line extending from the axis of the hub 136 to the air inlet 118. In this embodiment, the angle contained between the air outlet 119 and the air inlet 118 preferably is, but not limited to, 90 degrees for illustration purposes only. In practice, the angle contained between the air outlet 119 and the air inlet 118 can be adjusted to 30 degrees (as shown in FIG. 4C) or 45 degrees (as shown in FIG. 4B) or 60 degrees (as shown in FIG. 4A) according to the size of the internal space of the electronic apparatus and the requirement of arrangement of the components.

Figure 3:
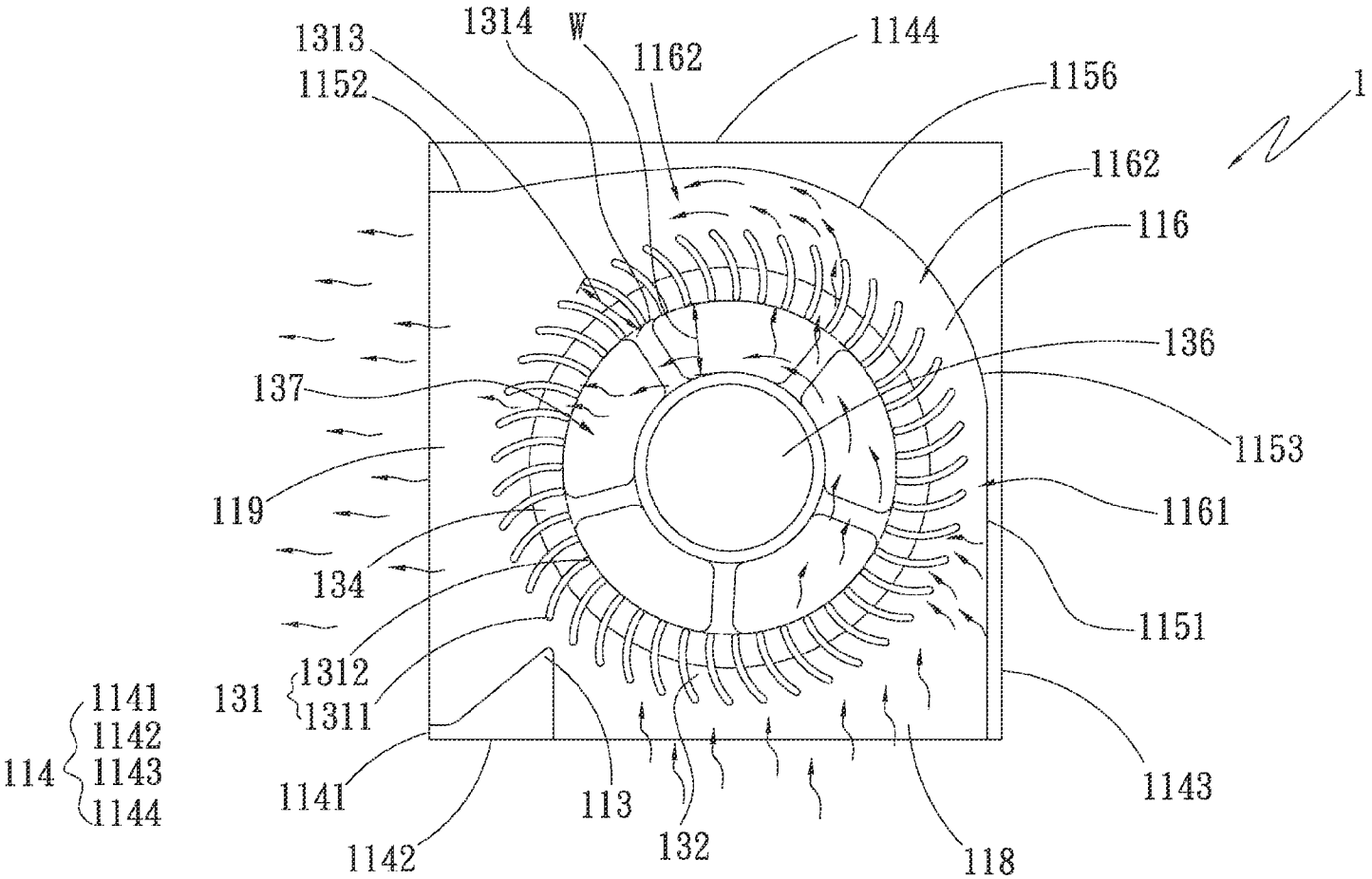
FIG. 3 is a top view of the first embodiment of the present invention.

Please now refer to FIGS. 1 and 3. The third and fourth sidewalls 1143, 1144 are adjacent to each other. The inner sides of the third and fourth sidewalls 1143, 1144 together form a first straight section 1151, a second straight section 1152, an initial curved section 1153 and an expansion curved section 1156. The first straight section 1151 is positioned in adjacency to the air inlet. One side of the initial curved section 1153 is connected with the first straight section 1151, while the other side of the initial curved section 1153 is connected with one side of the expansion curved section 1156. The second straight section 1152 is positioned in adjacency to the air outlet 119 and connected with the other side of the expansion curved section 1156. In other words, the first straight section 1151 extends from the inner side of the third sidewall 1143 in adjacent to the air inlet 118 toward the air outlet 119 to sequentially connect with the initial curved section 1153, the expansion curved section 1156 and the second straight section 1152 positioned on the inner side of the fourth sidewall 1144 in adjacency to the air outlet 119.

Figure 7:
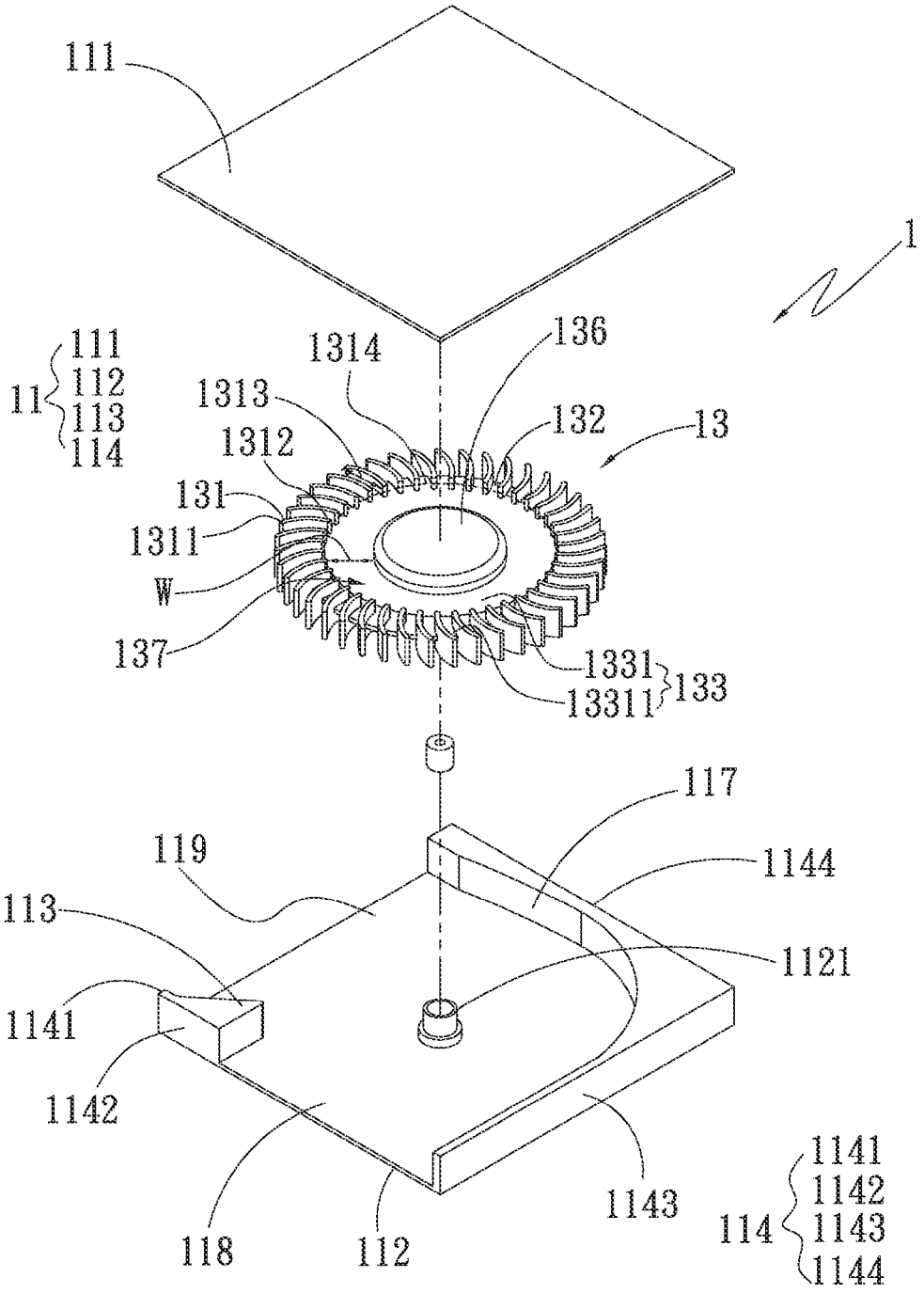
FIG. 7 is another perspective exploded view of the first embodiment of the present invention.

The fan impeller 13 is received in the receiving space 117. The fan impeller 13 has multiple blades 131, an extension section 133 and a hub 136. The extension section 133 outward extends from an outer circumference of the hub 136. The blades 131 are disposed on the extension section 133 in a direction away from the hub 136. The extension section 133 has multiple extension arms 1331 outward extending from the outer circumference of the hub 136. Each extension arm 1331 has a free end 13311. The free ends 13311 are connected with each other to form an annular body 134. The blades 131 are annularly disposed on the annular body 134. Each two adjacent blades 131 define therebetween a flow guide passage 132. Each two adjacent extension arms 1331 define therebetween a space 135 in communication with the receiving space 117. In practice, alternatively, the extension section 133 can be an annular extension arm 1331 in the form of a disc as shown in FIG. 7. The annular extension arm 1331 outward extends from the outer circumference of the hub 136. The blades 131 are annularly disposed on an outer circumference of the annular extension arm 1331 distal from the hub 136.

Each blade 131 has a front end 1311 and a rear end 1312. The front end 1311 of the blade 131 outward protrudes from the outer circumference of the annular body 134. In this embodiment, the rear end 1312 of the blade 131 is, but not limited to, flush with an inner circumference of the annular body 134 to face the outer circumference of the hub 136 for illustration purposes. In practice, alternatively, the rear end 1312 of the blade 131 can inward protrude from the inner circumference of the annular body 134 to face the hub 136. The rear ends 1312 of the blades 131 are annularly arranged to together define a virtual geometrical configuration 1314. A flow guide space 137 is defined between the virtual geometrical configuration 1314 and the hub 136 in communication with the receiving space 117 and the flow guide passages 132. A chord length 1313 is defined between the front end 1311 and the rear end 1312 of the blade 131. The width W of the flow guide space 137 is larger than or equal to the chord length 1313 of the blade 131. For example, provided the width of the flow guide space 137 is 1.5 cm, the chord length 1313 of the blade 131 is 1.1 cm or the width of the flow guide space 137 is 1.1 cm, the chord length 1313 of the blade 131 is also 1.1 cm.

The width W of the flow guide space 137 is larger than or equal to the chord length 1313 of the blade 131, whereby the ambient airflow can be effectively radially guided from the air inlet 118 into the fan frame 11. The airflow will be pressurized by the blades 131 to flow into the flow guide space 137 of the receiving space 117. Then the airflow is further pressurized by the blades 131 of the fan impeller 13 to radially flow toward the air outlet 119. Then the airflow is guided from the air outlet 119 to outer side. Accordingly, the performance of the fan is greatly enhanced. Moreover, the present invention is such designed that the blades 131 are disposed on the hub 136 in a radial direction (or horizontal direction) so that the axial height of the hub 136 is reduced. Therefore, the total axial height of the fan frame 11 is also reduced. In this case, the thickness is saved and the centrifugal fan 1 can be thinned.

Please refer to FIGS. 1 to 3. The front ends 1311 of the blades 131 are adjacent to the stop tongue section 113. In addition, a flow way 116 is defined between the front ends 1311 of the blades 131 and the third and fourth sidewalls 1143, 1144 in communication with the flow guide passages 132. The width of the flow way 116 is gradually enlarged from the initial curved section 1153 to the expansion curved section 1156. The flow way 116 includes a high-wind-pressure section 1161 with narrow width and a low-wind-pressure section 1162 with wider width. The high-wind-pressure section 1161 is positioned in the first straight section 1151 in adjacency to the initial curved section 1153, while the low-wind-pressure section 1162 is positioned in the initial curved section 1153, the expansion curved section 1156 and the air outlet 119. When the fan impeller 13 of the centrifugal fan 1 operates, the blades 131 of the fan impeller 13 will guide the ambient airflow from the air inlet 118 into the fan frame 11 in a radial direction. Then the airflow is pressurized by the blades 131 to flow through the flow guide passages 132 into the flow guide space 137. At this time, part of the airflow that flows toward the first straight section 1151 will encounter the high flow resistance of the high-wind-pressure section 1161 to be guided by the blades 131 into the flow guide space 137, (that is, to be guided by the blades 131 to the flow guide space 137 with lower pressure). Then, the blades 131 of the fan impeller 13 will further pressurize the airflow to make part of the airflow smoothly flow through the flow guide passages 132 into the initial curved section 1153 and the expansion curved section 1156 of the low-wind-pressure section 1162 of the flow way 116. When the airflow flows to the expansion curved section 1156 of the flow way 116, the airflow will be pressurized by the expansion curved section 1156 to be guided to the second straight section 1152 in a radial direction and then guided out of the air outlet 119. Other part of the airflow is directly guided from the flow guide passages 132 to the air outlet 119 and then guided to the outer side. Accordingly, the performance of the fan is enhanced and the thickness is saved.

According to the above arrangement, the air inlet 118 and the air outlet 119 are disposed on two sides of the fan frame 11 and the width of the flow guide space 137 is larger than or equal to the chord length 1313 of the blade 131, whereby the noise is effectively lowered and the thickness is saved. In addition, the performance of the fan is effectively enhanced.

Figure 5A:
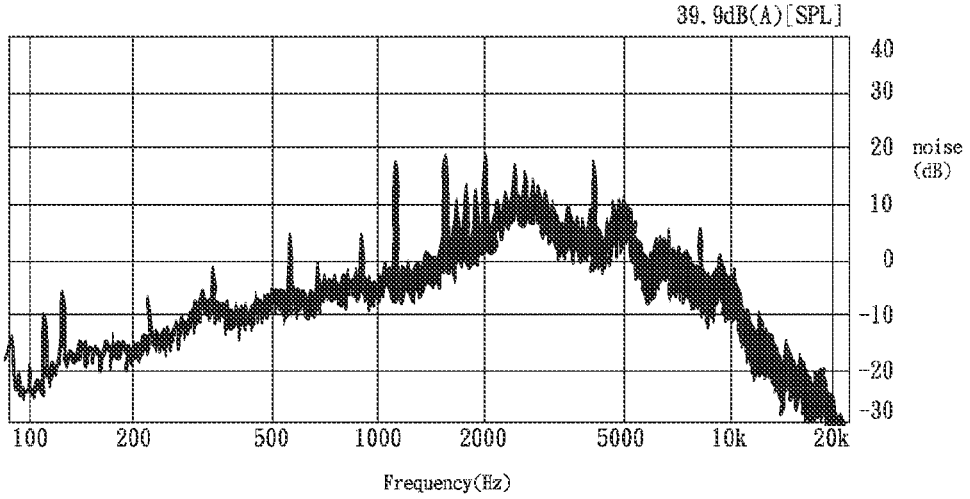
FIG. 5A is a noise spectrogram of the first embodiment of the centrifugal fan of the present invention.
Figure 5B:
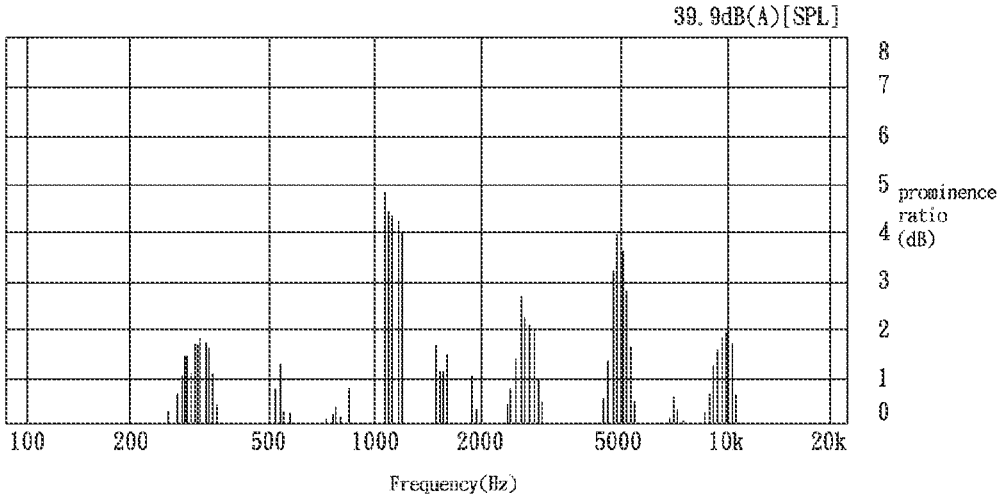
FIG. 5B is a prominence ratio spectrogram of the first embodiment of the centrifugal fan of the present invention.
Figure 6A:
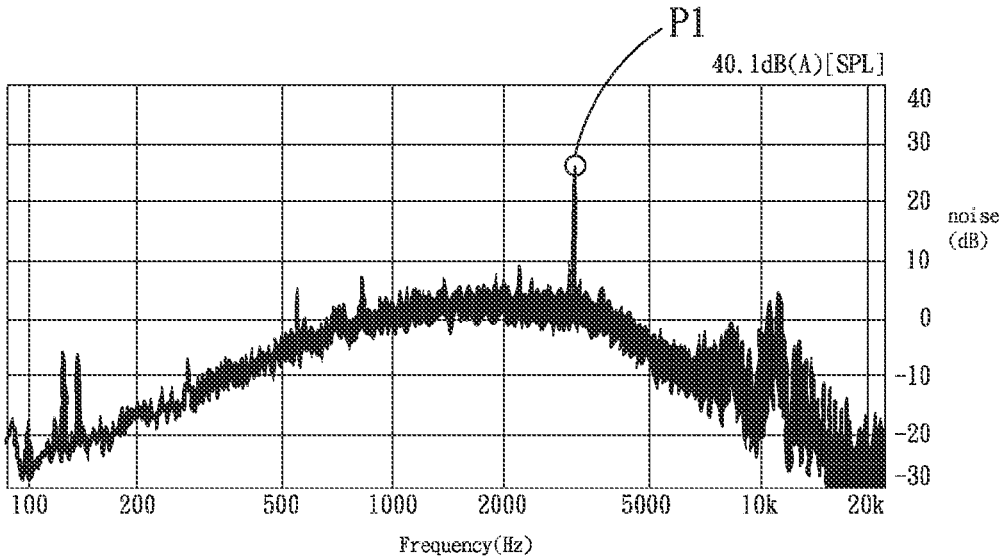
FIG. 6A is a noise spectrogram of the conventional centrifugal fan.
Figure 6B:
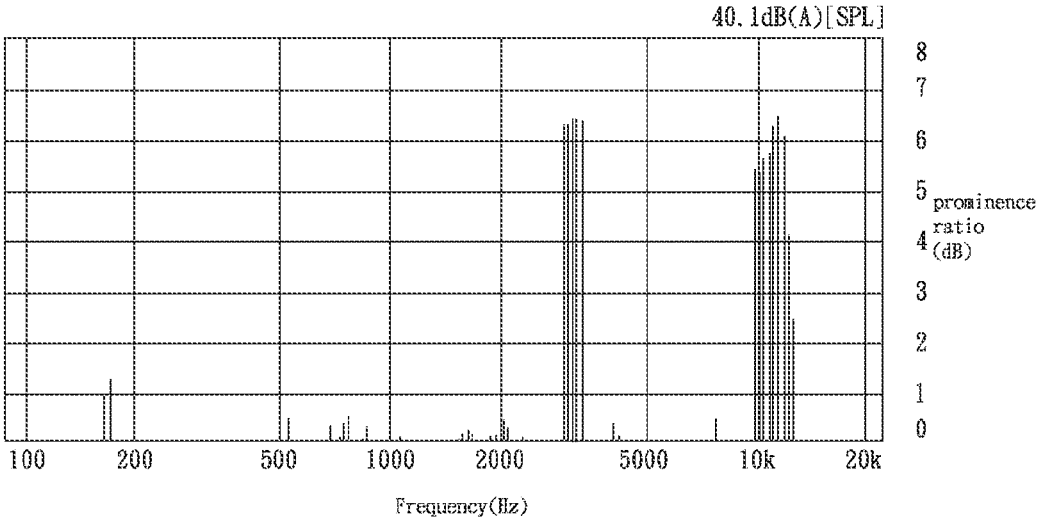
FIG. 6B is a prominence ratio spectrogram of the conventional centrifugal fan.

Please refer to FIGS. 5A-6B, which are noise test comparison diagrams between the centrifugal fan 1 of the present invention and the conventional centrifugal fan. FIG. 6A is a noise spectrogram of the conventional centrifugal fan. FIG. 6B is a prominence ratio spectrogram of the conventional centrifugal fan. It can be found from the noise spectrogram of FIG. 6A that at a certain rotational speed of the fan impeller, the conventional centrifugal fan will generate a higher fan impeller frequency peak value P1 of about 29 dB. In addition, it can be seen from FIG. 6B that there is a higher prominence ratio corresponding to the fan impeller frequency peak value P1. The prominence ratio is approximately 7 dB.

FIG. 5A is a noise spectrogram of the centrifugal fan 1 of the present invention. FIG. 5B is a prominence ratio spectrogram of the centrifugal fan 1 of the present invention. It can be seen from FIG. 5A that in this embodiment, the fan impeller frequency peak value of the centrifugal fan 1 is about 19 dB. It can be seen from FIG. 5B that there is a higher prominence ratio corresponding to the fan impeller frequency peak value. The prominence ratio is approximately 5 dB. When the prominence ratio is over 6 dB, it is judged that the noise is a prominent noise. Therefore, it can be known from the above analysis that the noise of the centrifugal fan 1 of the present invention is apparently much lower than the noise of the conventional centrifugal fan. Accordingly, the design of the centrifugal fan 1 of the present invention can achieve a noise-lowering effect.

Figure 8A:
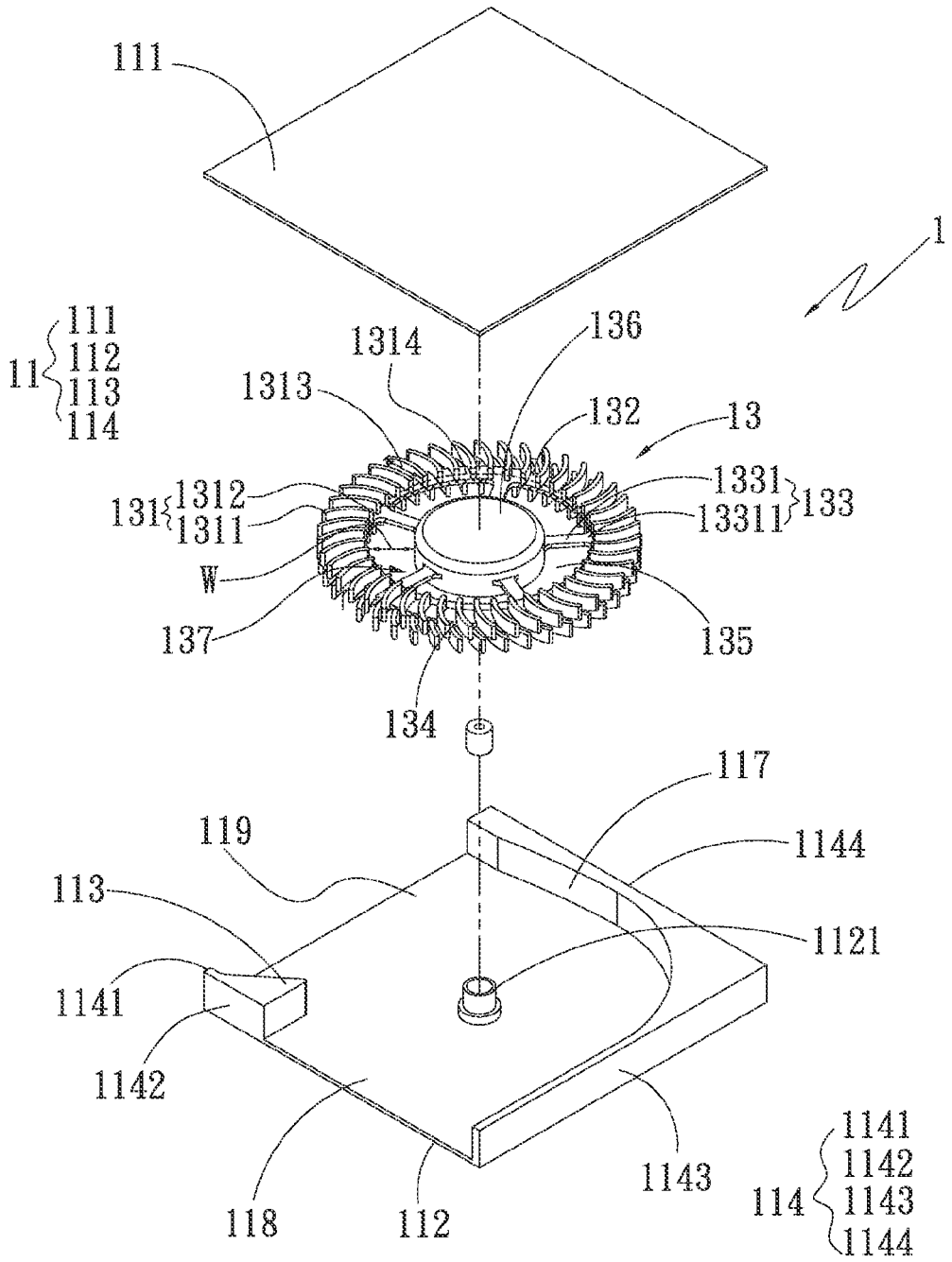
FIG. 8A is a perspective exploded view of a second embodiment of the present invention.
Figure 8B:
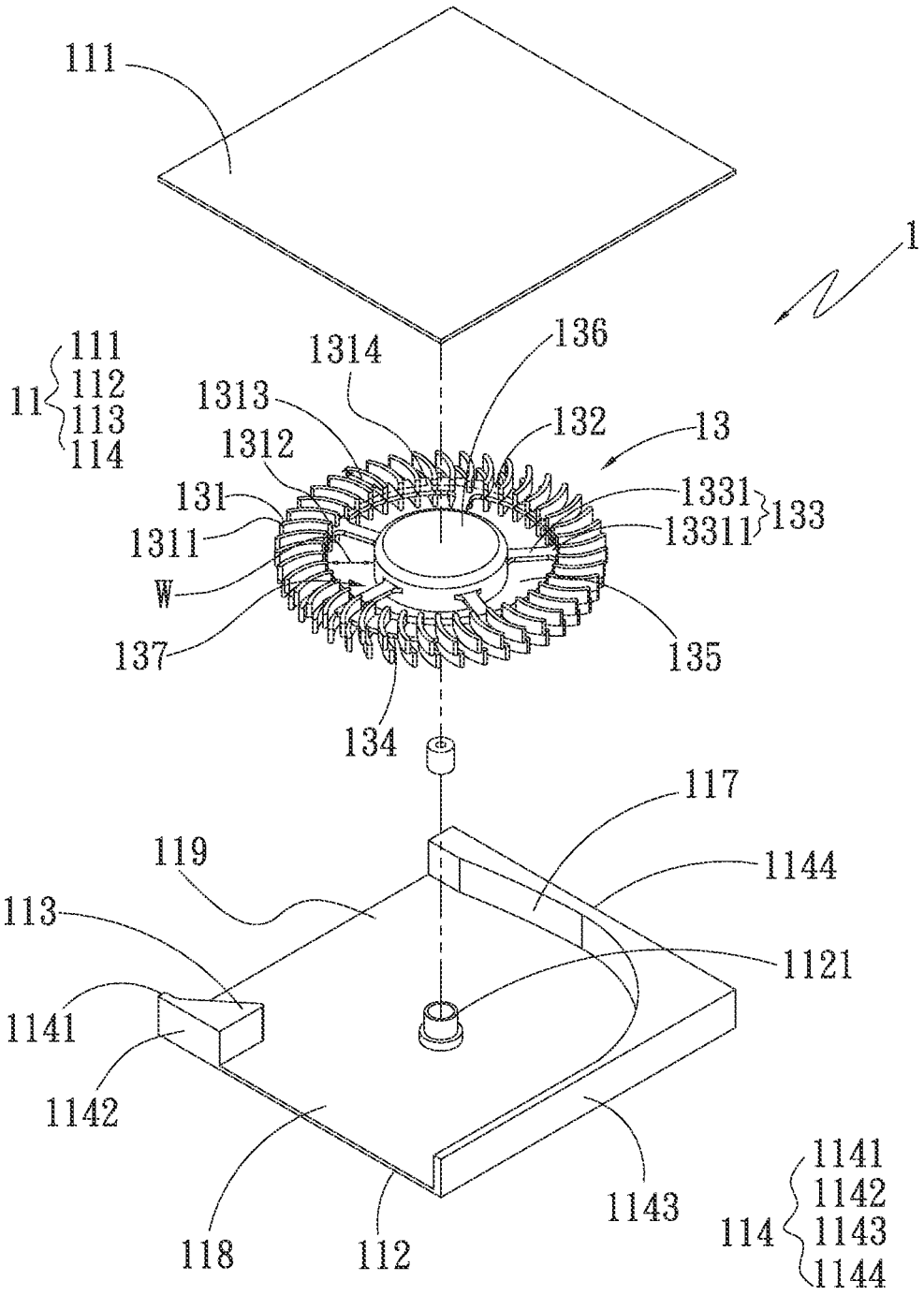
FIG. 8B is another perspective exploded view of the second embodiment of the present invention.

Please now refer to FIGS. 8A and 8B. FIG. 8A is a perspective exploded view of a second embodiment of the present invention. FIG. 8B is another perspective exploded view of the second embodiment of the present invention. The second embodiment is substantially identical to the first embodiment in structure, connection relationship and effect and thus will not be repeatedly described hereinafter. The second embodiment is mainly different from the first embodiment in that multiple blades 131 are alternately arranged on the annular body 134. That is, some blades 131 are annularly arranged on an upper face of the annular body 134, while some other blades 131 are annularly arranged on a lower face of the annular body 134. The blades 131 on the upper face and the blades 131 on the lower faces are alternately arranged.

According to the above, the upper and lower blades 131 are alternately arranged on the upper and lower faces of the annular body 134. This can effectively lower the noise of the fan.

In conclusion, in comparison with the conventional centrifugal fan, the present invention has the following advantages:

1. The thickness is saved.
2. The performance of the centrifugal fan is enhanced.
3. The noise is lowered.

The present invention has been described with the above embodiments thereof and it is understood that many changes and modifications in the above embodiments can be carried out without departing from the scope and the spirit of the invention that is intended to be limited only by the appended claims.

What is claimed is:

1. A centrifugal fan comprising:

a fan frame, an upper side and a lower side of the fan frame being closed, the fan frame having a plurality of sidewalls between the upper side and the lower side, an internal receiving space, the fan frame having at least one air inlet and at least one air outlet in communication with the receiving space, the air inlet and the air outlet being respectively formed on one side of the fan frame and another side of the fan frame, remaining sides being closed sidewalls with a straight and curved inner side configuration; and a fan impeller received in the receiving space, the fan impeller having multiple blades, an extension section and a hub, the extension section outward extending from an outer circumference of the hub, the blades being disposed on the extension section in a direction away from the hub, each blade having a front end and a rear end, the rear ends of the blades being annularly arranged to together define a virtual geometrical configuration, a flow guide space being defined between the virtual geometrical configuration and the hub, a chord length being defined between the front end and the rear end of the blade, the flow guide space having a width larger than or equal to the chord length of the blade.

2. The centrifugal fan as claimed in claim 1, wherein the fan frame further has a cover board, a bottom board, a stop tongue section and a sideboard, the sideboard upward extending from a periphery of the bottom board, the sideboard including a first sidewall, a second sidewall, a third sidewall and a fourth sidewall, the air inlet and the air outlet being respectively formed on the first and second sidewalls, the cover board being disposed at one end of the sideboard, which end is distal from the bottom board, to cover the receiving space, the cover board, the bottom board and the sideboard together defining the receiving space, the stop tongue section extending from a junction between the first and second sidewalls into the receiving space in adjacency to and corresponding to the front ends of the blades.

3. The centrifugal fan as claimed in claim 2, wherein the third and fourth sidewalls are adjacent to each other, wherein inner sides of the third and fourth sidewalls together form a first straight section, a second straight section, an initial curved section and an expansion curved section, the first straight section being positioned in adjacency to the air inlet, one side of the initial curved section being connected with the first straight section, while the other side of the initial curved section being connected with one side of the expansion curved section, the second straight section being positioned in adjacency to the air outlet and connected with the other side of the expansion curved section.

4. The centrifugal fan as claimed in claim 3, wherein a flow way is defined between the front ends of the blades and the third and fourth sidewalls, the flow way having a width, which is gradually enlarged from the initial curved section to the expansion curved section, the flow way including a high-wind-pressure section with narrow width and a low-wind-pressure section with wider width.

5. The centrifugal fan as claimed in claim 4, wherein each two adjacent blades define therebetween a flow guide passage in communication with the flow way and the flow guide space, the extension section having multiple extension arms outward extending from the outer circumference of the hub, each extension arm having a free end, the free ends being connected with each other to form an annular body, the blades being annularly disposed on the annular body, each two adjacent extension arms defining therebetween a space in communication with the flow guide space.

6. The centrifugal fan as claimed in claim 5, wherein an angle is contained between the air outlet and the air inlet, the angle ranging from 30 degrees to 90 degrees.

7. The centrifugal fan as claimed in claim 3, wherein an angle is contained between the air outlet and the air inlet, the angle ranging from 30 degrees to 90 degrees.

8. The centrifugal fan as claimed in claim 2, wherein an angle is contained between the air outlet and the air inlet, the angle ranging from 30 degrees to 90 degrees.

9. The centrifugal fan as claimed in claim 4, wherein an angle is contained between the air outlet and the air inlet, the angle ranging from 30 degrees to 90 degrees.

10. The centrifugal fan as claimed in claim 1, wherein an angle is contained between the air outlet and the air inlet, the angle ranging from 30 degrees to 90 degrees.

11. The centrifugal fan as claimed in claim 1, wherein the extension section having multiple extension arms outward extending from the outer circumference of the hub, each extension arm having a free end, the free ends being connected with each other to form an annular body, a plurality of the blades being annularly arranged on an upper face of the annular body, while a plurality of other of the blades being annularly arranged on a lower face of the annular body, the blades on the upper face and the blades on the lower faces being alternately arranged.

* * * * *